US012281845B2

(12) United States Patent
Vincentelli et al.

(10) Patent No.: US 12,281,845 B2
(45) Date of Patent: Apr. 22, 2025

(54) HEAT RECOVERY STEAM GENERATION INTEGRATION WITH HIGH PRESSURE FEED GAS PROCESSES FOR THE PRODUCTION OF LIQUEFIED NATURAL GAS

(71) Applicant: ExxonMobil Technology and Engineering Company, Spring, TX (US)

(72) Inventors: Jorge Vincentelli, Spring, TX (US); Yijun Liu, Spring, TX (US); Ananda K Nagavarapu, Houston, TX (US); Xiaoli Y. Wright, Sugar Land, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 240 days.

(21) Appl. No.: 18/005,478

(22) PCT Filed: May 20, 2021

(86) PCT No.: PCT/US2021/070585
§ 371 (c)(1),
(2) Date: Jan. 13, 2023

(87) PCT Pub. No.: WO2022/016164
PCT Pub. Date: Jan. 20, 2022

(65) Prior Publication Data

US 2023/0258401 A1 Aug. 17, 2023

Related U.S. Application Data

(60) Provisional application No. 63/053,050, filed on Jul. 17, 2020.

(51) Int. Cl.
*F01K 15/00* (2006.01)
*F25J 1/02* (2006.01)
*F25J 1/00* (2006.01)

(52) U.S. Cl.
CPC ..... *F25J 1/0242* (2013.01); *F01K 15/00* (2013.01); *F25J 1/0022* (2013.01)

(58) Field of Classification Search
CPC ..... F25J 1/0022; F25J 1/0035; F25J 1/0042; F25J 1/005; F25J 1/0052; F25J 1/0057;
(Continued)

(56) References Cited

U.S. PATENT DOCUMENTS 7,357,092 B2 * 4/2008 Park ..... B63B 35/44 290/1 A
8,492,043 B2 * 7/2013 Shintani ..... H01M 8/0258 429/456

(Continued)

OTHER PUBLICATIONS

Rabeau et al., "How to Reduce CO2 Emissions in the LNG Chain", Apr. 24, 2007., International Conference and Exhibition on Liquefied Natural Gas.

*Primary Examiner* — Filip Zec
(74) *Attorney, Agent, or Firm* — Vorys, Sater, Seymour and Passe LLP

(57) ABSTRACT

A method of producing LNG. According to the method, a natural gas stream is compressed using first and second compressors. A cooler cools the natural gas stream so that the second compressor produces a cooled, compressed natural gas stream, which is liquefied in a liquefaction process. The liquefaction process uses a refrigerant compressor configured to compress a stream of refrigerant used to chill, condense, or liquefy the cooled, compressed natural gas stream. Using a heat recovery steam generation (HRSG) system, heat is recovered from a power source of the refrigerant compressor. A stream of pressurized steam is
(Continued)

generated from the recovered heat. At least one of the first and second compressors is powered using at least part of the stream of pressurized steam.

11 Claims, 8 Drawing Sheets

(58) Field of Classification Search
CPC ..... F25J 1/0072; F25J 1/0082; F25J 1/0205; F25J 1/0212; F25J 1/0214; F25J 1/0242; F25J 1/027; F25J 1/0282; F25J 1/0283; F25J 1/0285; F25J 1/0289; F25J 2220/62; F25J 2230/20; F25J 2230/22; F25J 2230/30; F25J 2240/70; F25J 2240/82
See application file for complete search history.

(56) References Cited

U.S. PATENT DOCUMENTS

| | | | | |
|---|---|---|---|---|
| 9,771,824 | B2 * | 9/2017 | Park | F02G 5/02 |
| 10,126,048 | B2 * | 11/2018 | Nagao | B63B 35/44 |
| 12,123,645 | B2 * | 10/2024 | Bernhardt | F25J 1/0225 |
| 2010/0071409 | A1 | 3/2010 | Kaart | |
| 2014/0260251 | A1 * | 9/2014 | Shapot | F01K 23/064 60/648 |
| 2016/0116209 | A1 | 4/2016 | Nagao et al. | |
| 2019/0376740 | A1 | 12/2019 | Liu et al. | |

* cited by examiner

HEAT RECOVERY STEAM GENERATION INTEGRATION WITH HIGH PRESSURE FEED GAS PROCESSES FOR THE PRODUCTION OF LIQUEFIED NATURAL GAS

CROSS REFERENCE TO RELATED APPLICATION

This application is a U.S. National Stage entry under 35 U.S.C. 371 of International Application No. PCT/US2021/070585 that published as WO/2022/016164 and was filed on 20 May 2021, which claims the priority benefit of U.S. Provisional Patent Application No. 63/053,050 filed Jul. 17, 2020, entitled HEAT RECOVERY STEAM GENERATION INTEGRATION WITH HIGH PRESSURE FEED GAS PROCESSES FOR THE PRODUCTION OF LIQUEFIED NATURAL GAS.

FIELD OF DISCLOSURE

The disclosure relates generally to the field of hydrocarbon processing plants. More specifically, the disclosure relates to the efficient design, construction and operation of hydrocarbon processing plants, such as LNG processing plants.

DESCRIPTION OF RELATED ART

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as admissions of prior art.

Liquefied natural gas (LNG) production is a rapidly growing means to supply natural gas from locations with an abundant supply of natural gas to distant locations with a strong demand for natural gas. The conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form liquefied natural gas at or near atmospheric pressure and about −160° C.; d) removal of light components from the LNG such as nitrogen and helium; e) transport of the LNG product in ships or tankers designed for this purpose to a market location; and f) re-pressurization and regasification of the LNG at a regasification plant to form a pressurized natural gas stream that may be distributed to natural gas consumers.

Step (c) of the liquefaction process is typically achieved using a vapor-compression or a gas-expansion cycle, both of which use one or more compressors to raise the refrigerant pressure to reject heat to the ambient. In large scale applications, these compressors are usually driven by one or more gas turbines. The fuel used to drive these gas turbines is composed of a slip stream of fresh feed gas and flash gas generated from LNG storage, loading, and sometimes from a process feed containing light impurities such as nitrogen gas. Extra fuel is often required to satisfy the other process heating needs in LNG production facilities, such as heating the feed gas, reboilers associated with acid gas removal units and/or fractionation columns, regeneration heat, and the like. All of these fuel requirements deplete the supply of feed gas that otherwise would be available for LNG production. Additionally, combusting the feed gas generates more carbon dioxide emissions, thereby negatively impacting the carbon footprint of the LNG production facility. What is needed is a method of producing LNG that maximizes the amount of feed gas that is liquefied while minimizing the carbon footprint of the liquefaction process.

SUMMARY

In one aspect, a method of producing liquefied natural gas (LNG) is provided. According to the method, a natural gas stream is provided at a pressure of less than 8.27 MPa (1,200 psia) from a supply of natural gas. The natural gas stream is compressed, using a first compressor and a second compressor, to a pressure of at least 10.34 MPa (1,500 psia). The natural gas stream is cooled between the first compressor and the second compressor so that the second compressor produces a cooled, compressed natural gas stream. The cooled, compressed natural gas stream is liquefied in a liquefaction process. The liquefaction process uses a refrigerant compressor configured to compress a stream of refrigerant used to chill, condense, or liquefy the cooled, compressed natural gas stream. Using a heat recovery steam generation (HRSG) system, heat is recovered from a power source of the refrigerant compressor and generating a stream of pressurized steam from the recovered heat. At least one of the first and second compressors is powered using at least part of the stream of pressurized steam.

In another aspect, a system is provided for producing LNG from a natural gas stream. A first compressor and a second compressor compress a natural gas stream from a pressure of less than 8.27 MPa (1,200 psia) to a pressure of at least 10.34 MPa (1,500 psia). A heat exchanger is disposed between the first compressor and the second compressor. The heat exchanger cools the natural gas stream so that the second compressor produces a cooled, compressed natural gas stream. A liquefaction process liquefies the cooled, compressed natural gas stream. The liquefaction process includes a refrigerant compressor that compresses a stream of refrigerant used to chill, condense, or liquefy the cooled, compressed natural gas stream. The refrigerant compressor is powered by a power source. A heat recovery steam generation (HRSG) system recovers heat from the power source of the refrigerant compressor to thereby generate a stream of pressurized steam from the recovered heat. At least one of the first and second compressors are powered using at least part of the stream of pressurized steam.

In still another aspect a method of producing LNG is provided. According to the method, a natural gas stream is provided, and the natural gas stream is liquefied in a liquefaction process. The liquefaction process uses a first compressor and a second compressor to compress one or more refrigerants used to chill, condense, or liquefy the chilled natural gas stream. The first compressor is powered with a gas turbine, and the second compressor is powered with a steam turbine. Using a heat recovery steam generation (HRSG) system, heat is recovered from the gas turbine and a stream of pressurized steam is generated from the recovered heat. The steam turbine is powered using at least part of the stream of pressurized steam.

In yet another aspect, a system for producing LNG from a natural gas stream is provided. A liquefaction process liquefies the natural gas stream. The liquefaction process includes a first compressor and a second compressor that compresses one or more refrigerants used to chill, condense, or liquefy the chilled natural gas stream. A gas turbine powers the first compressor. A steam turbine powers the second compressor. A heat recovery steam generation (HRSG) system recovers heat from the gas turbine and generates a stream of pressurized steam from the recovered heat. The steam turbine is powered using at least part of the stream of pressurized steam.

DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation. The forms disclosed herein are illustrated by way of example, and not by way of limitation, in the figures of the accompanying drawings and in which like reference numerals refer to similar elements and in which:

DETAILED DESCRIPTION

Terminology

Figure 1:
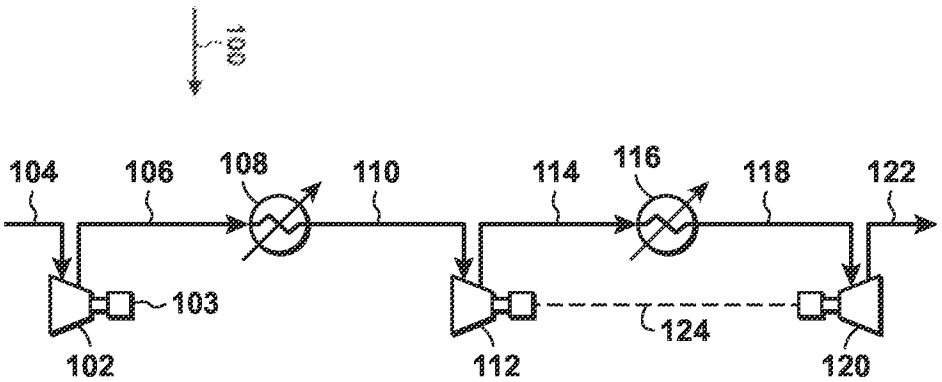
FIG. 1 (Prior Art)
FIG. 1 is a schematic diagram of a high pressure compression and expansion (HPCE) module or system according to known aspects.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based at least in part on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on.

May: the word "may" is used throughout this application in a permissive sense (i.e., having the potential to, being able to), not a mandatory sense (i.e., must).

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

DESCRIPTION

Specific aspects of the disclosure will now be described further by way of example. While the following examples demonstrate certain forms of the subject matter disclosed herein, they are not to be interpreted as limiting the scope thereof, but rather as contributing to a complete description.

Aspects disclosed herein describe a process for pre-cooling natural gas to a liquefaction process for the production of LNG by the addition of a high pressure compression and high pressure expansion process to the feed gas. More specifically, the invention describes a process where a pretreated natural gas stream is compressed to pressure greater than 2000 psia (13,790 kPa), or more preferably greater than 3000 psia (20,680 kPa). The hot compressed gas is cooled by exchanging heat with the environment to form a compressed pretreated gas. The compressed pretreated gas may be near-isentropically expanded to a pressure less than 3000 psia (20,680 kPa), or more preferably to a pressure less than 2000 psia (13,790 kPa) to form a chilled pretreated gas, where the pressure of the chilled pretreated gas is less than the pressure of the compressed pretreated gas. The chilled pretreated gas may be directed to one or more liquefaction trains, where the gas is further cooled to form LNG.

FIG. 1 is an illustration of a pre-cooling process as disclosed in United States Patent Application Publication No. US2017/0167786, the disclosure of which is incorporated by reference herein in its entirety. The pre-cooling process is referred to herein as a high pressure compression and expansion (HPCE) process, and is accomplished using the system shown at reference number 100. The HPCE system 100 may comprise a first compressor 102 which compresses a pretreated natural gas stream 104 to form an intermediate pressure gas stream 106. First compressor 102, which may also be called a feed compressor herein, typically is powered by a motor or gas turbine 103. The intermediate pressure gas stream 106 may flow through a first heat exchanger 108 where the intermediate pressure gas stream 106 is cooled by indirectly exchanging heat with the environment to form a cooled intermediate pressure gas stream 110. The first heat exchanger 108 may be an air cooled heat exchanger or a water cooled heat exchanger. The cooled intermediate pressure gas stream 110 may then be compressed within a second compressor 112 to form a high pressure gas stream 114. The pressure of the high pressure gas stream 114 may be greater than 2000 psia (13,790 kPa), or more preferably greater than 3000 psia (20,680 kPa). The high pressure gas stream 114 may flow through a second heat exchanger 116 where the high pressure gas stream 114 is cooled by indirectly exchanging heat with the environment to form a cooled high pressure gas stream 118. The second heat exchanger 116 may be an air cooled heat exchanger or a water cooled heat exchanger. The cooled high pressure gas stream 118 may then be optionally expanded within an expander 120 to form a chilled pretreated gas stream 122. The pressure of the chilled pretreated gas stream 122 may be less than 3000 psia (20,680 kPa), or more preferably less than 2000 psia (13,790 kPa), and the pressure of the chilled pretreated gas stream 122 is less than the pressure of the cooled high pressure gas stream 118. In a preferred aspect, the second compressor 112 may be driven solely by the shaft power produced by the expander 120, as indicated by the dashed line 124.

Figure 2:
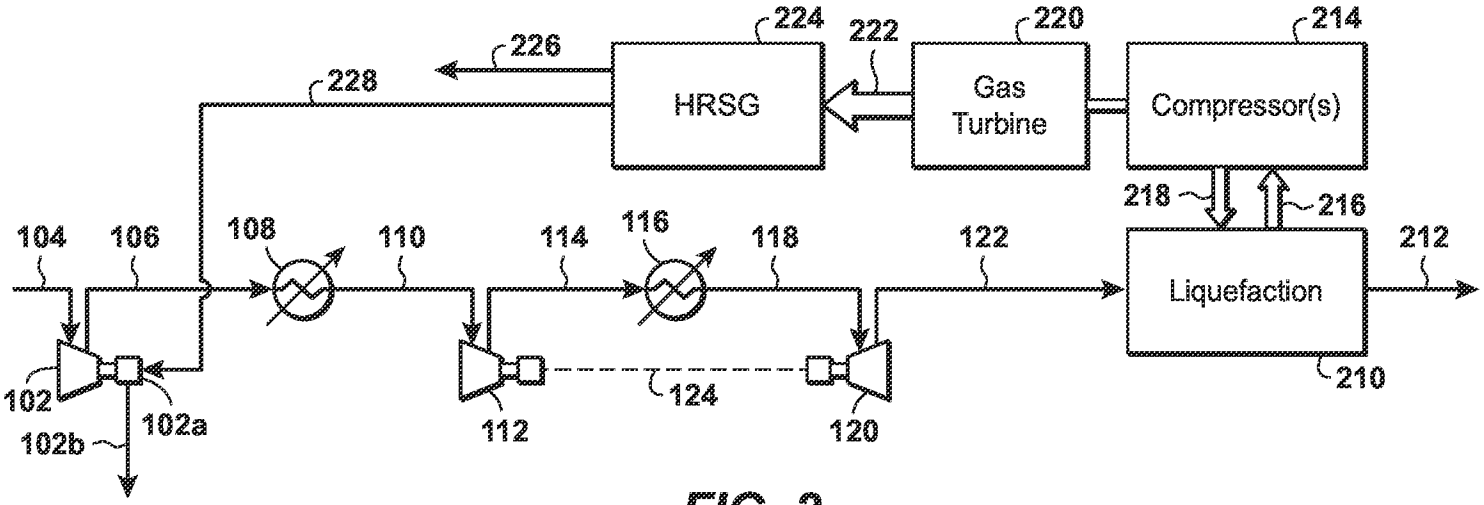
FIG. 2 is a schematic diagram of a system for producing LNG according to aspects of the disclosure.

According to disclosed aspects, HPCE system 100 may be used to compress and cool a feed stream of a natural gas liquefaction system. FIG. 2 schematically depicts this combination. HPCE system 100 as previously described is shown delivering a chilled pretreated gas stream 122 to a natural gas liquefaction system 210 to produce liquefied natural gas (LNG) 212 therefrom. Natural gas liquefaction system 210 relies upon compressors 214 for the heating/cooling cycles of the refrigerant streams 216, 218 used in the liquefaction process. Gas turbines 220 provide power for the compressors 214. Heat 222 generated by the gas turbines 220 may be captured by a heat recovery steam generator (HRSG) unit, shown schematically at 224. According to known principles, HRSG unit 224 uses direct or indirect heat exchange to generate one or more streams 226, 228 of high-pressure heated steam from heat 222. Stream 226 is optional and may be used in various ways, such as heating, electricity generation, and the like. Stream 228 is directed to a steam turbine 102*a* that is configured to drive first compressor 102. Steam turbine 102*a* may be a condensing type steam turbine with or without side extraction, or a back pressure type steam turbine. In such a configuration, the steam turbine 102*a* may consume part or all of the steam generated by the HRSG unit 224 depending on process configurations, site location, gas properties, and other factors. As an example, for a three-train hot climate LNG project with nominal 3 MTA per train capacity using a liquefaction module with methane and nitrogen cooling and a single HPCE unit supplying feed gas to all three trains, the thermal energy distribution is listed in Table 1.

| | Plant | Thermal Energy Distribution | HRSG Users Distribution |
|---|---|---|---|
| Source | Combustion heat of fuel gas supplied to refrigerant gas turbine(s) (220) | 100% | |
| User | Energy driven refrigerant gas turbine(s) | 37% | |
| Dissipated | Unrecoverable waste heat in exhaust gas | 23% | |
| User | Recoverable waste heat via HRSG (224) to Feed Steam Turbine (102a) | 33% | 83.4% |
| User | Recoverable waste heat via HRSG (224) to Plant thermal users (via 226) | 7% | 16.6% |

As shown, the steam turbine 102*a* uses the majority of the heat recovered, and the steam produced, by the HRSG unit 224, eliminating the fuel gas needed to drive the first compressor 102 and also conveniently allowing the excess thermal capacity 226 from the HRSG unit to supply process heat, covering all process heating needs, or generating electrical power. Therefore, the need for an expensive steam-to-power generation system is minimized or eliminated. Furthermore, some process heating needs may be provided with side extracted steam 102*b* from the above steam turbine 102*a*. This has two advantages: all steam used for heating is also used for delivering shaft power, and the size of the associated steam vacuum condenser becomes smaller in size. Instead of using a condensing type steam turbine, other types of steam turbines may be used, including a turbine using side extraction or a back pressure steam type steam turbine may be used, including for an end flash gas (EFG) compressor.

Figure 3:
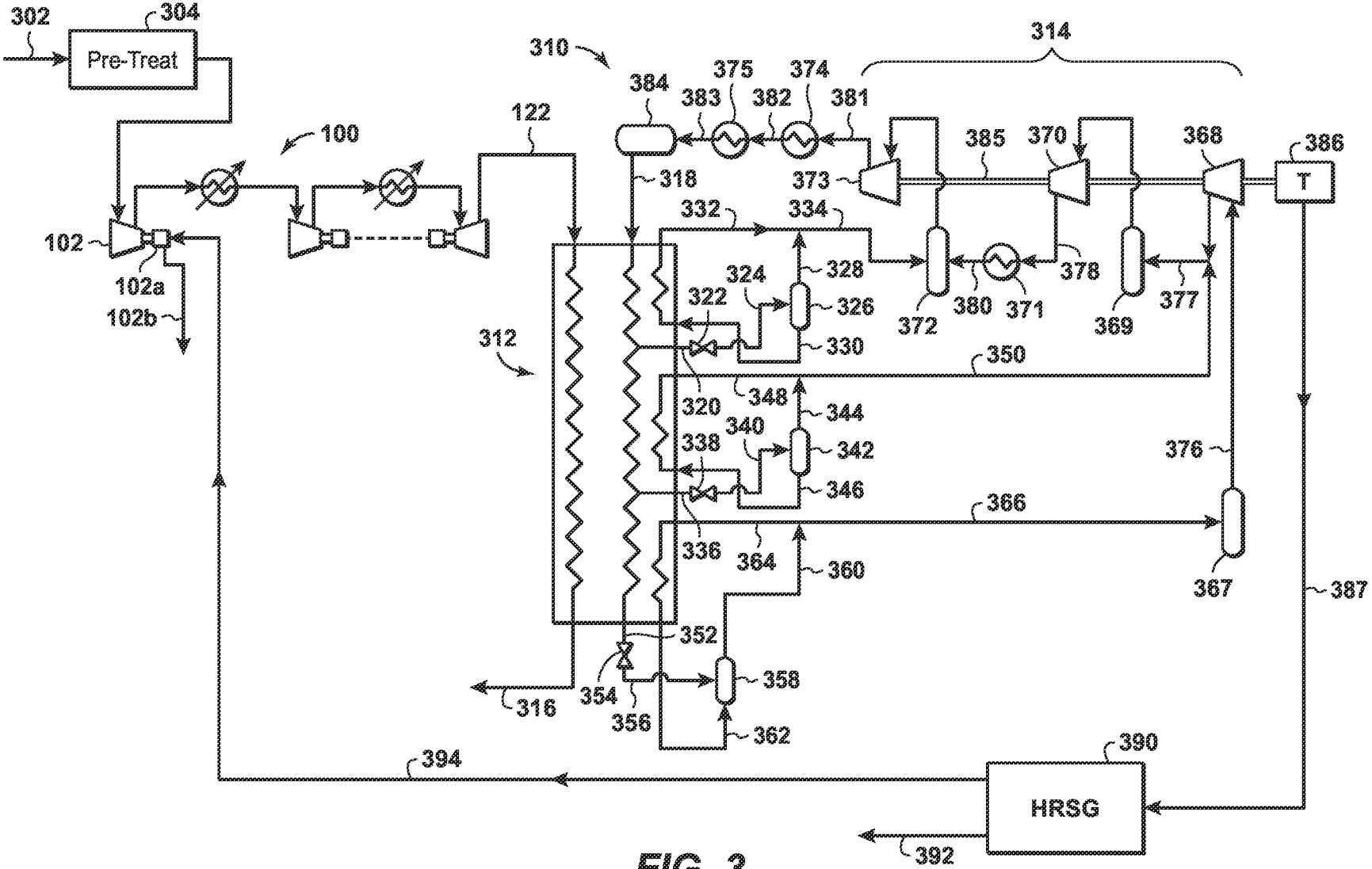
FIG. 3 is a schematic diagram of a system for producing LNG according to aspects of the disclosure.

FIG. 3 illustrates a system and process for producing liquefied natural gas (LNG) according to aspects of the disclosure. Feed gas (natural gas) enters through inlet line 302 into one or more pre-treatment modules 304 where it is treated to remove contaminants. The pre-treatment modules may include dehydration units to remove water from the feed gas. The pre-treatment modules may include scrubbers and/or flash tanks to remove other contaminants such as sulfur compounds, carbon dioxide, and heavy hydrocarbons. The treated gas then passes from the pre-treatment modules 304 to the HPCE system 100 as previously described. For the sake of brevity a full description of HPCE system 100 will not be repeated. The output of the HPCE system 100 is a chilled pretreated gas stream 122, which is directed to a liquefaction system 310. The liquefaction system 310 depicted in FIG. 3 is a single mixed refrigerant (SMR) liquefaction system, which uses a mixed refrigerant to liquefy a natural gas stream in a single refrigeration subprocess. Non-limiting examples of single mixed refrigerant liquefaction systems are disclosed in commonly owned U.S. Patent Application Publication No. 2007/0227185, the disclosure of which is incorporated by reference herein in its entirety. Liquefaction system 310 uses a heat exchanger 312 having two or more heat exchangers contained therein, and a MCR compression unit 314. The chilled pretreated gas stream 122 is directed to the heat exchanger 312 where it is cooled against a mixed component refrigerant ("MCR") stream 318 within the heat exchanger 312 and exits as a chilled stream 316. In an aspect, the MCR stream 318 may be a mixture of ethane, propane and isobutane. The MCR stream 318 may contain between about 20 mole % and 80 mole % of ethane, between about 10 mole % and 90 mole % of propane, and between about 5 mole % and 30 mole % of isobutane. Other components and proportions thereof may be included in the MCR stream 318.

Continuing with FIG. 3, MCR stream 318 enters the heat exchanger 312. At least a portion of MCR stream 318 is withdrawn from a first heat exchange area of the heat exchanger 312 as a side stream 320. The side stream 320 is expanded to a first pressure using an expansion device 322, producing a two-phase stream 324 (i.e. a stream having a vapor phase and a liquid phase). This first pressure may range from a low of 800 kPa, or 1,200 kPa, or 1,500 kPa to a high of 1,900 kPa, or 2,200 kPa, or 2,600 kPa. Accordingly, the temperature of the two-phase stream 324 ranges from a low of 0° C., or 3° C., or 4° C. to a high of 6° C., or 10° C., or 15° C. Preferably, the side stream 320 is expanded to a pressure of from 1,600 kPa to 1,800 kPa and a temperature of from 4° C. to 6° C.

The two-phase stream 324 is then separated within a separator 326 to produce a vapor stream 328 and a liquid stream 330. Preferably, the two-phase stream 324 is subjected to a flash separation. The vapor stream 328 bypasses the heat exchanger 312 and is sent directly to the compression unit 314. Bypassing the refrigerant vapor around the heat exchange area to the compression unit eliminates problems associated with the use of two-phase refrigerants. After being reduced in pressure and thus cooled, the liquid stream 330 returns to the heat exchanger 312 where it is completely evaporated or partially evaporated due to the heat exchange within the heat exchanger. This completely evaporated or partially evaporated stream exits the heat exchanger 312 as stream 332, which may have a vapor fraction of at least 85% by weight, or at least 90% by weight, or at least 99% by weight, and the balance is the liquid phase fraction. Alternatively, stream 332 is a vapor stream having no liquid phase (i.e. completely evaporated). Stream 332 may be combined with the vapor stream 328 from the separator 326 to form a recycle stream 334 that flows to the compression unit 314.

At least another portion of MCR stream 318 is withdrawn from a second heat exchange area of the heat exchanger 312 as a side stream 336. The side stream 336 is expanded to a second pressure using an expansion device 338, producing a stream 340 having a vapor phase and a liquid phase. This second pressure may range from a low of 250 kPa, or 400 kPa, or 500 kPa to a high of 600 kPa, or 700 kPa, or 850 kPa. Accordingly, the temperature of stream 340 ranges from a low of −60° C., or −50° C., or −40° C. to a high of −30° C., or −20° C., or −10° C. Preferably, the side stream 336 is expanded to a pressure of from 550 kPa to 570 kPa and a temperature of from −35° C. to −45° C. The stream 340 is then separated within a separator 342 to produce a vapor stream 344 and a liquid stream 346. Preferably, the stream 340 is subjected to a flash separation. The vapor stream 344 bypasses the heat exchanger 312 and is sent directly to the compression unit 314. The liquid stream 346, having been reduced in pressure and thus cooled, returns to the heat exchanger 312 where it is completely evaporated or partially evaporated due to the heat exchange therein. This completely evaporated or partially evaporated stream exits the heat exchanger 312 as stream 348, which may have a vapor fraction of at least 85% by weight, or at least 90% by weight, or at least 99% by weight, and the balance is the liquid phase fraction. Stream 348 may be combined with vapor stream 344 to form a recycle stream 350 that flows to the compression unit 314.

Yet another portion of MCR stream 318 is withdrawn from a third heat exchange area of the heat exchanger 312 as a side stream 352. The side stream 352 is expanded to a third pressure using an expansion device 354, producing an expanded stream 356 that has a vapor phase and a liquid phase. In one or more specific embodiments, this third pressure ranges from a low of 80 kPa, or 120 kPa, or 150 kPa to a high of 180 kPa, or 200 kPa, or 250 kPa. Accordingly, the temperature of the expanded stream 356 ranges from a low of −110° C., or −90° C., or −80° C. to a high of −60° C., or −50° C., or −30° C. Preferably, the side stream 352 is expanded to a pressure of from 160 kPa to 180 kPa and a temperature of from −65° C. to −75° C.

The two-phase stream 356 is then separated within a separator 358 to produce a flash vapor stream 360 and a saturated liquid stream 362. Preferably, the two-phase stream 356 is subjected to a flash separation. The vapor stream 360 bypasses the heat exchanger 312 and is sent directly to the compression unit 314. The saturated liquid stream 362, having been reduced in pressure and thus cooled, returns to the heat exchanger 312 where it is completely evaporated or partially evaporated due to the heat exchange within the heat exchanger 312. This completely evaporated or partially evaporated refrigerant exits the heat exchanger 312 as stream 364. In one or more specific embodiments, stream 364 has a vapor fraction of at least 85% by weight, or at least 90% by weight, or at least 99% by weight, and the balance is the liquid phase fraction. Stream 364 may be combined with the vapor stream 364 from the separator 358 to form a recycle stream 366 that flows to the compression unit 314.

According to disclosed aspects, one or more of the expansion devices 322, 338, 354 may be any pressure reducing device. Illustrative expansion devices include, but are not limited to valves, control valves, Joule Thompson valves, Venturi devices, liquid expanders, hydraulic turbines, and the like. The expansion devices may be automatically actuated expansion valves or Joule Thompson-type valves.

As described above, the vapor streams 328, 344, 360 bypass the heat exchanger 312 and are sent directly to the compression unit 314. This bypass configuration avoids the distribution problems associated with two-phase refrigerants. Furthermore, the partially evaporated refrigerant exiting the heat exchange area with two phases has been configured to reduce mechanical stress within the heat exchange area. Mechanical stress may be a product of a rapid temperature transition across the volume occupied by a liquid phase and the volume occupied by a vapor phase. The temperature transition from the volume of the liquid or two-phase fluid portion to the volume of the vapor portion may result in stress fracture during startups, shutdowns, or upsets, or may result in fatigue failure of the exchanger. Therefore, configuring the refrigerant flow conditions allows for incomplete vaporization of the refrigerant liquid streams 330, 346 and 362 without the inherent effects of mechanical stress caused by a rapid temperature gradient. To transition from a system in which the refrigerant is fully evaporated to a system in which the refrigerant is partially evaporated, the flow rate may be increased, the evaporation pressure may be changed, the refrigerant composition may be changed to include more components with higher boiling points, or a combination of any of these design parameters.

The MCR compression unit 314 may include a single compression stage, or preferably includes multiple compression stages capable of operating at different pressure levels. Preferably, the suction of each compression stage corresponds to the pressure levels of the recycle streams 334, 350, 366. According to disclosed aspects, the first compression stage includes a suction knock-out vessel 367 and a compressor 368. The second compression stage includes a suction knock-out vessel 369, a compressor 370, and a discharge cooler or condenser 371. The third compression stage includes a suction knock-out vessel 372, a compressor 373, and a discharge cooler 374. In at least one specific embodiment, the compression unit 314 further includes a final cooler or condenser 375.

The coolers 371, 374, and 375 may be any type of heat exchanger suitable for the process conditions described herein. Illustrative heat exchangers include, but are not limited to, shell-and-tube heat exchangers, core-in-kettle exchangers and brazed aluminum plate-fin heat exchangers. Plant cooling water or air may be used as the heat transfer medium to cool the process fluid within the coolers. The bypassed flash vapor streams 328, 344, 360 may cool the at least partially evaporated refrigerant streams 332, 348, 364 exiting the heat exchanger 312. As such, the combined streams 334, 350, 366, which recycle to the suction to the compression unit 314, are lower in temperature thereby reducing the duty requirements of the discharge coolers 371, 374, and 375.

Referring to the compression unit in more detail, stream 376 exits suction knock-out vessel 367 and is compressed by compressor 368. The output stream 377 of compressor 368 may have a pressure ranging from a low of 200 kPa, or 300 kPa, or 400 kPa to a high of 600 kPa, or 700 kPa, or 800 kPa. The temperature of output stream 377 ranges from a low of 5° C., or 10° C., or 15° C. to a high of 20° C., or 25° C., or 30° C. Output stream 377 is directed to suction knock-out drum 369 and then to compressor 370, which forms part of the second compression stage. The output stream 378 exits the compressor 370 and is cooled within the discharge cooler 371 to produce stream 380. The pressure of output stream 378 may range from a low of 800 kPa, or 1,200 kPa, or 1,400 kPa to a high of 1,800 kPa, or 2,000 kPa, or 2,500 kPa. The temperature of stream 380 ranges from a low of 15° C., or 25° C., or 35° C. to a high of 40° C., or 45° C., or 55° C. Stream 380 is directed to suction knock-out drum 372 and then to compressor 373, which forms part of the third compression stage. The output stream 381 exits the compressor 373 and is cooled within the discharge cooler 374 to produce stream 382. The pressure of output stream 381 ranges from a low of 1,600 kPa, or 2,400 kPa, or 2,900 kPa to a high of 3,500 kPa, or 4,000 kPa, or 5,000 kPa. The temperature of output stream 381 ranges from a low of 40° C., or 50° C., or 60° C. to a high of 100° C., or 120° C., or 150° C. In one or more specific embodiments, the temperature of stream 382 ranges from a low of 0° C., or 110° C., or 20° C. to a high of 40° C., or 50° C., or 60° C. Stream 382 flows to the condenser 375 to produce stream 383. The temperature of stream 383 ranges from a low of 0° C., or 10° C., or 20° C. to a high of 40° C., or 45° C., or 55° C. Stream 383 flows to a surge vessel 384 to provide residence time for operability considerations as the high pressure liquid refrigerant enters heat exchanger 312 as MCR stream 318.

Compressors 368, 370, and 373 are shown as separate compressors but may represent compression stages of a single compressor. In any event, one or more of the compressors 368, 370, and 373 may be powered by one or more turbines. An exemplary method is depicted in FIG. 3 in which a single shaft 385 connects the compressors to a gas turbine 386. Heat 387 generated by the gas turbine 386 may be captured by a HRSG unit 390. HRSG unit 390 uses direct or indirect heat exchange to generate one or more streams 392, 394 of high-pressure heated steam from heat 387. Stream 392 may be used in various ways, such as heating, electricity generation, and the like. Stream 394 is directed to a steam turbine 102*a* that is configured to drive first compressor 102. Steam turbine 102*a* may be a condensing type steam turbine or another type of steam turbine as discussed herein. The steam turbine 102*a* uses the majority of the steam produced by the HRSG unit 390, eliminating the fuel gas needed to drive the first compressor 102 and also conveniently allowing the excess thermal capacity 392 from the HRSG unit to supply process heat, reaching nearly perfect energy balance. Furthermore, some process heating needs may be provided with side extracted steam 102*b* from the steam turbine 102*a*.

Figure 4:
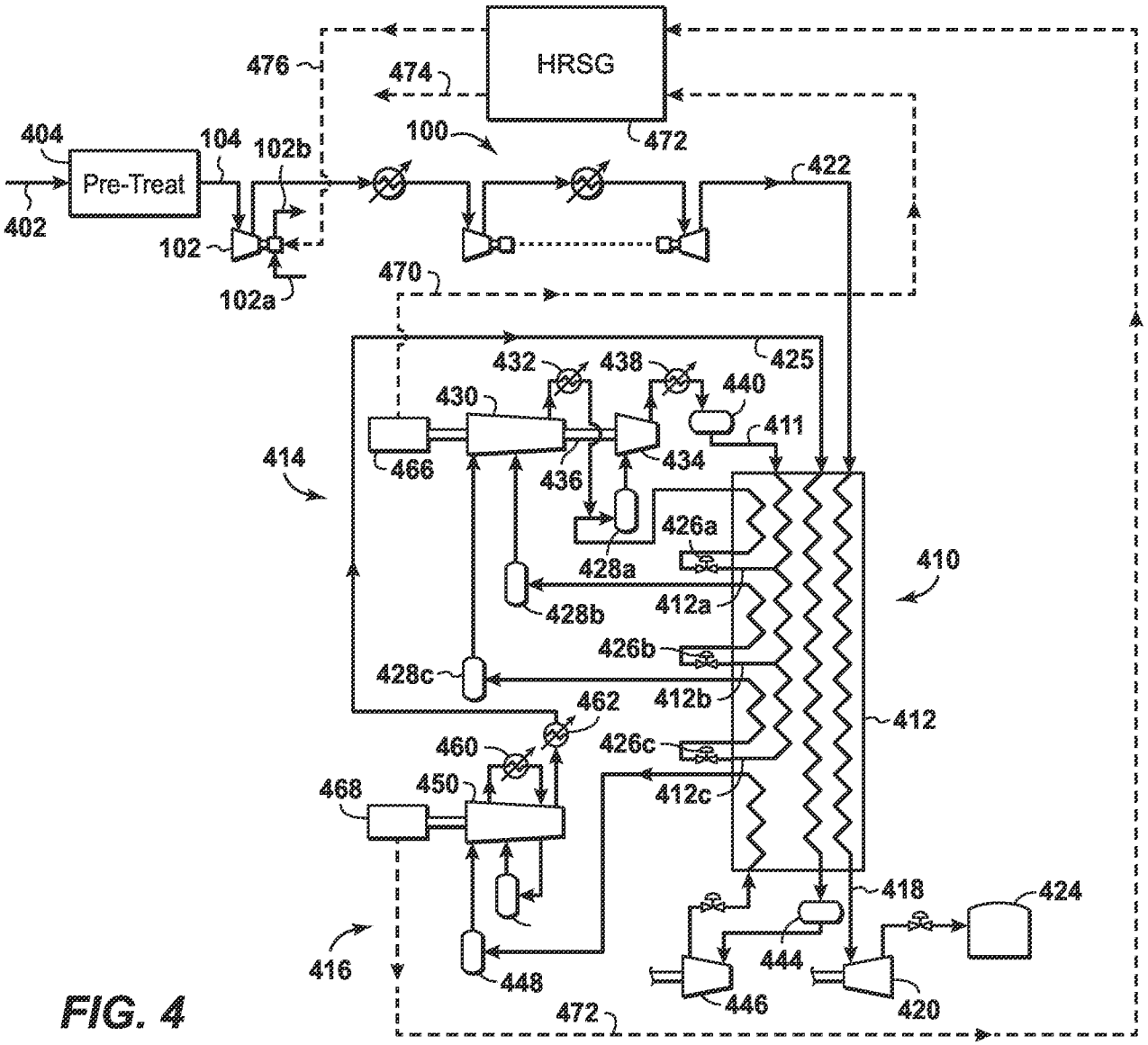
FIG. 4 is a schematic diagram of a system for producing LNG according to aspects of the disclosure.

FIG. 4 illustrates a system and process for producing liquefied natural gas (LNG) according to other aspects of the disclosure. Feed gas (natural gas) enters through inlet line 402 into one or more pre-treatment modules 404 where it is treated to remove contaminants. The pre-treatment modules may include dehydration units to remove water from the feed gas. The pre-treatment modules may include scrubbers and/or flash tanks to remove other contaminants such as sulfur compounds, carbon dioxide, and heavy hydrocarbons. The treated gas then passes from the pre-treatment modules 404 to the HPCE system 100 as previously described. For the sake of brevity a full description of HPCE system 100 will not be repeated. The output of the HPCE system 100 is a chilled pretreated gas stream 422, which is directed to a liquefaction system 410. The liquefaction system 410 depicted in FIG. 4 is a dual mixed refrigerant liquefaction system, which employs two refrigeration sub-processes (here shown as two separate mixed refrigerant cycles) in a heat exchanger 412 to liquefy the chilled pretreated gas stream. A warm mixed refrigerant, circulating in a warm mixed refrigerant cycle 414, chills the chilled pretreated gas stream to a first lower temperature, which may be between −50° F. to −150° F., (between −45° C. and −101° C.), with the actual temperature being a process optimization variable. A cold mixed refrigerant, circulating in a cold mixed refrigerant cycle 416, further cools the chilled pretreated gas stream to the final cryogenic temperatures. The resulting cryogenic fluid 418 is then reduced in pressure, preferably by a cryogenic turbine 420, and is stored in LNG storage tank 424 or transported as required.

The warm mixed refrigerant may be primarily composed of ethane with smaller amounts of propane and iso-butane. The warm mixed refrigerant enters the heat exchanger 412 at 411 and is split into multiple portions 412*a*, 412*b*, 412*c*. Each portion provides cooling to the chilled pretreated gas stream, exits the heat exchanger, is reduced in pressure by a valve 426*a*, 426*b*, 426*c*, re-enters the heat exchanger to provide further cooling to the chilled pretreated gas stream, and exits the heat exchanger to be directed to a knock-out vessel 428*a*, 428*b*, 428*c*, respectively. The outputs of knock-out vessels 428*b* and 428*c* are directed to the first two stages of a first compressor 430 to a pressure that is sufficient to fully condense it against the available ambient cooling medium. The combined output of the first two stages of the first compressor is cooled in an ambient cooler 432 and directed to the knockout vessel 428*a*. The output of the knock-out vessel 428*a* is directed to a third stage 434 of the first compressor, which is depicted schematically as being separate from compressor 430 and connected by a common shaft 436 thereto. The output of the third stage 434 is cooled in an ambient cooler 438 and sent to a surge drum 440 that feeds the heat exchanger with stream 411, thereby completing the warm mixed refrigerant cycle 414.

The cold mixed refrigerant may be primarily methane with smaller amounts of ethane, nitrogen, and propane. The refrigeration duty of the cold mixed refrigerant, which enters the heat exchanger at 425 and is evaporated therein at a single pressure level, is used to cool the chilled pretreated gas stream 422 to cryogenic temperatures. Cold mixed refrigerant exiting the heat exchanger 412 is collected in a knockout drum 444 and expanded in a cryogenic expander 446, after which it re-enters the heat exchanger 412. The cold mixed refrigerant exiting the heat exchanger the second time enters a knock-out vessel 448 and is then compressed in two stages in a second compressor 450 to a pressure sufficient to completely condense it against the warm mixed refrigerant in the heat exchanger. The cold mixed refrigerant from the second compressor is cooled in ambient coolers 460, 462 before being directed to the inlet 425 of the heat exchanger, thereby completing the cold mixed refrigerant cycle 416.

First and second compressors 430, 450 are driven by first and second gas turbines 466, 468, respectively. Heat 470, 472 generated by one or more of the gas turbines may be captured by a HRSG unit 472. HRSG unit 472 uses direct or indirect heat exchange to generate one or more streams 474, 476 of high-pressure heated steam from heat 470 and/or 472. Stream 474 may be used in various ways, such as heating, electricity generation, and the like. Stream 476 is directed to a steam turbine 102*a* that is configured to drive first compressor 102. Steam turbine 102*a* may be a condensing type steam turbine or other type of steam turbine as discussed herein. The steam turbine 102*a* uses the majority of the steam produced by the HRSG unit 472, eliminating the fuel gas needed to drive the first compressor 102 and also conveniently allowing the excess thermal capacity 474 from the HRSG unit to supply process heat, reaching nearly perfect energy balance. Furthermore, process heating needs may be provided with side extracted steam 102*b* from the steam turbine 102*a*.

The disclosed aspects are applicable for a variety of liquefaction processes including single mixed refrigerant liquefaction processes as shown in FIG. 3, high pressure expander liquefaction processes, and dual mixed-refrigerant liquefaction processes such as that shown in FIG. 4.

Figure 5:
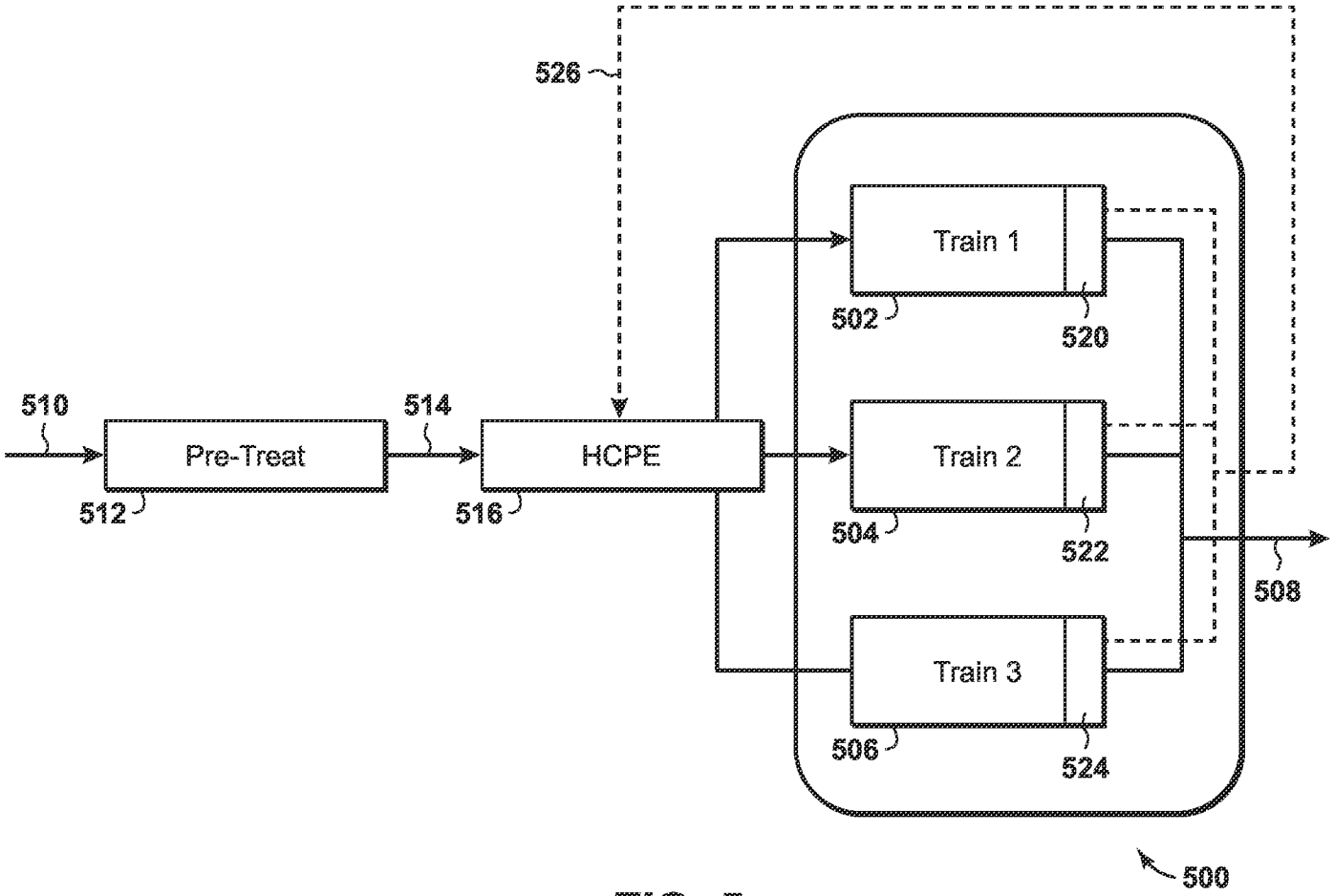
FIG. 5 is a schematic diagram of a system for producing LNG using multiple liquefaction trains according to aspects of the disclosure.

The combined liquefaction and HRSG capabilities of the disclosed aspects as shown in FIG. 2, FIG. 3, and/or FIG. 4 may comprise an LNG train, which may be combined with similar LNG trains, either in series or in parallel, to maximize LNG production. Such combination is shown in FIG. 5, in which a schematic diagram is shown of an LNG plant 500. LNG plant 500 includes at least two LNG trains, and in FIG. 5 first, second, and third LNG trains 502, 504, 506 are shown. The LNG trains may use any known type of liquefaction process that includes one or more compressors to compress the feed stream, a refrigerant, a chilled or condensed LNG stream, or other process stream. The LNG trains produce an LNG stream 508. LNG plant 500 includes pre-treatment equipment 512 that removes impurities from an LNG feed stream 510. The pre-treatment equipment may include dehydrators to remove moisture or water vapor from the feed stream. The pre-treatment equipment may also include one or more separators or scrub columns to remove other impurities, such as sulfur compounds, carbon dioxide, heavy hydrocarbons, and the like. The resulting pretreated feed gas stream 514 is directed to an HPCE module 516, which is the same as the HPCE modules previously described herein. HPCE module 516 is sized to provide a sufficient supply of chilled, pretreated gas stream to first, second, and third LNG trains 502, 504, 506. HRSG modules 520, 522, 524 included in each LNG train generate a combined stream of heated steam 526 for the steam turbine powering the steam compressor of the HPCE module 516, as previously described.

Figure 6:
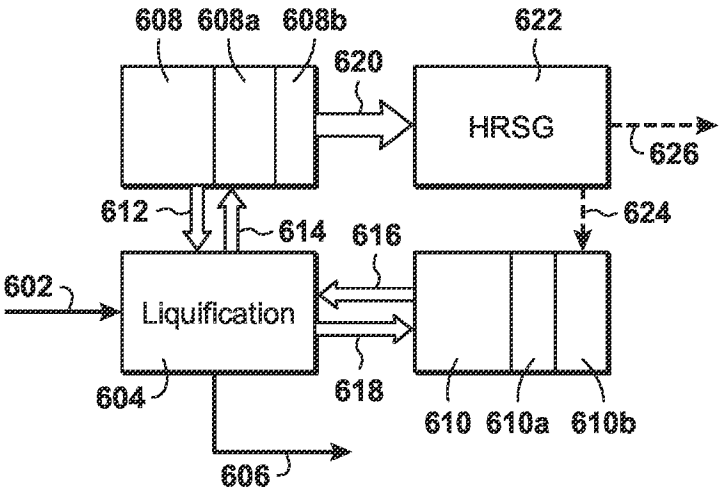
FIG. 6 is a schematic diagram of a system for producing LNG according to aspects of the disclosure.
Figure 7:
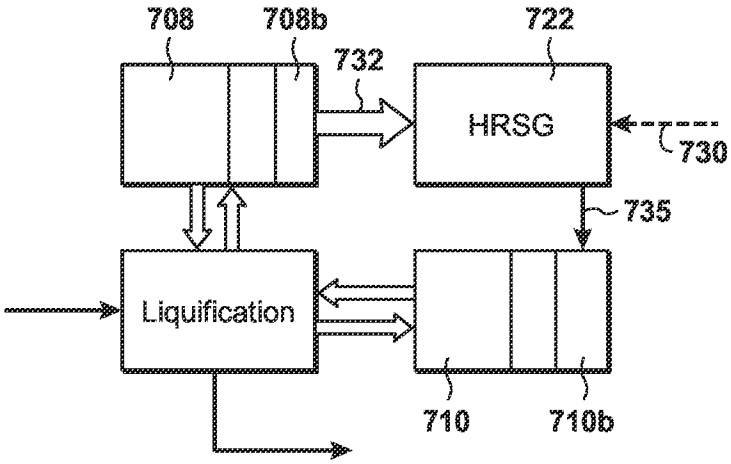
FIG. 7 is a schematic diagram of a system for producing LNG according to aspects of the disclosure.

In another aspect of the disclosure, the use of a HRSG unit may be integrated with one or more of the refrigerant cycles. For example, the steam generated from the HRSG unit may be used to directly drive the warm mixed refrigerant compressor and/or a front-end auxiliary compressor. Then, depending on the amount power (in the form of steam) available from the HRSG unit, the compression load of a compressor associated with one refrigerant cycle may be adjusted with respect to the compression load of a compressor associated with another refrigerant cycle. FIG. 6 schematically depicts an example of such an integration. A gas stream 602 is liquefied by a natural gas liquefaction system 604 to produce LNG 606 therefrom. Like liquefaction system 410 of FIG. 4, the liquefaction system 604 has first and second refrigerant loops 608, 610. Each of the refrigerant loops includes and relies on compressors 608*a*, 610*a* for the heating/cooling cycles of the respective refrigerant streams 612, 614, 616, 618 used in the liquefaction process. A gas turbine 608*b* powers the compressor(s) 608*a* of the first refrigerant loop 608, and a steam turbine 610*b* powers the compressor(s) 610*b* of the second refrigerant loop 610. Heat 620 generated by the gas turbine 608*b* may be captured by HRSG unit 622, and steam 624 generated by HRSG unit 622 may be used to power the steam turbine 610*b*. The compression load between the compressor(s) 608*a* (which may be a warm mixed refrigerant compressor) and the compressor(s) 610*a* (which may be a cold mixed refrigerant compressor) may be shifted as needed to account for the power available from the steam generated in the HRSG. Additional steam 626 may be used in other processes within or outside the liquefaction process shown in FIG. 6. Furthermore, the disclosed aspects may permit the use of a smaller driver or design of a larger train and potentially eliminate the need for power generation systems from steam. FIG. 7 depicts another aspect of the disclosure in which heat 732 generated by the gas turbine 708*b* of the first refrigerant loop 708 may be used to generate steam in the HRSG unit 722. Optionally, heat 730 from other thermal sources, such as a fired heater, may also be used to generate steam 735 using HRSG unit 722, thereby helping balance the supply of steam necessary to power steam turbine 710*b* of the second refrigerant loop 710.

Figure 8:
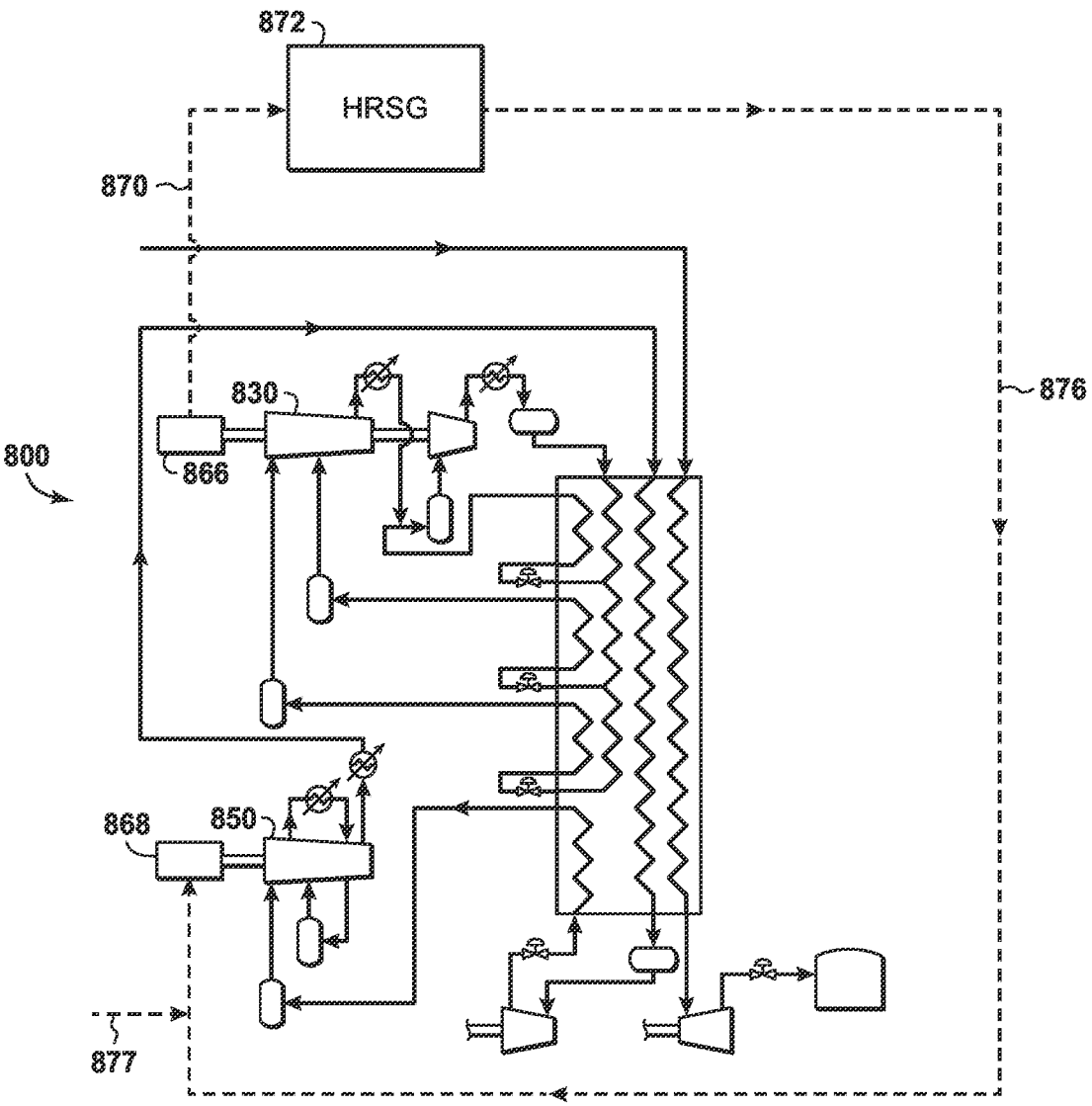
FIG. 8 is a schematic diagram of a system for producing LNG according to aspects of the disclosure.

The arrangement of FIG. 6 is shown in more detail in FIG. 8, which is a schematic diagram of a dual mixed refrigerant system 800 for producing LNG according to disclosed aspects. System 800 is similar to the system and process shown in FIG. 4, but does not include the HPCE system 100 of FIG. 4. System 800 includes a gas turbine 866 to power the compressor(s) 830 tasked with compressing the warm mixed refrigerant. System 800 also includes a steam turbine 868 to power the compressor(s) 850 tasked with compressing the cold mixed refrigerant. Heat 870 generated by steam turbine 866 is used in the HRSG unit 872 to generate steam 876, which is used to power steam turbine 868. Additional steam 877 may supplement the steam 876.

Figure 9:
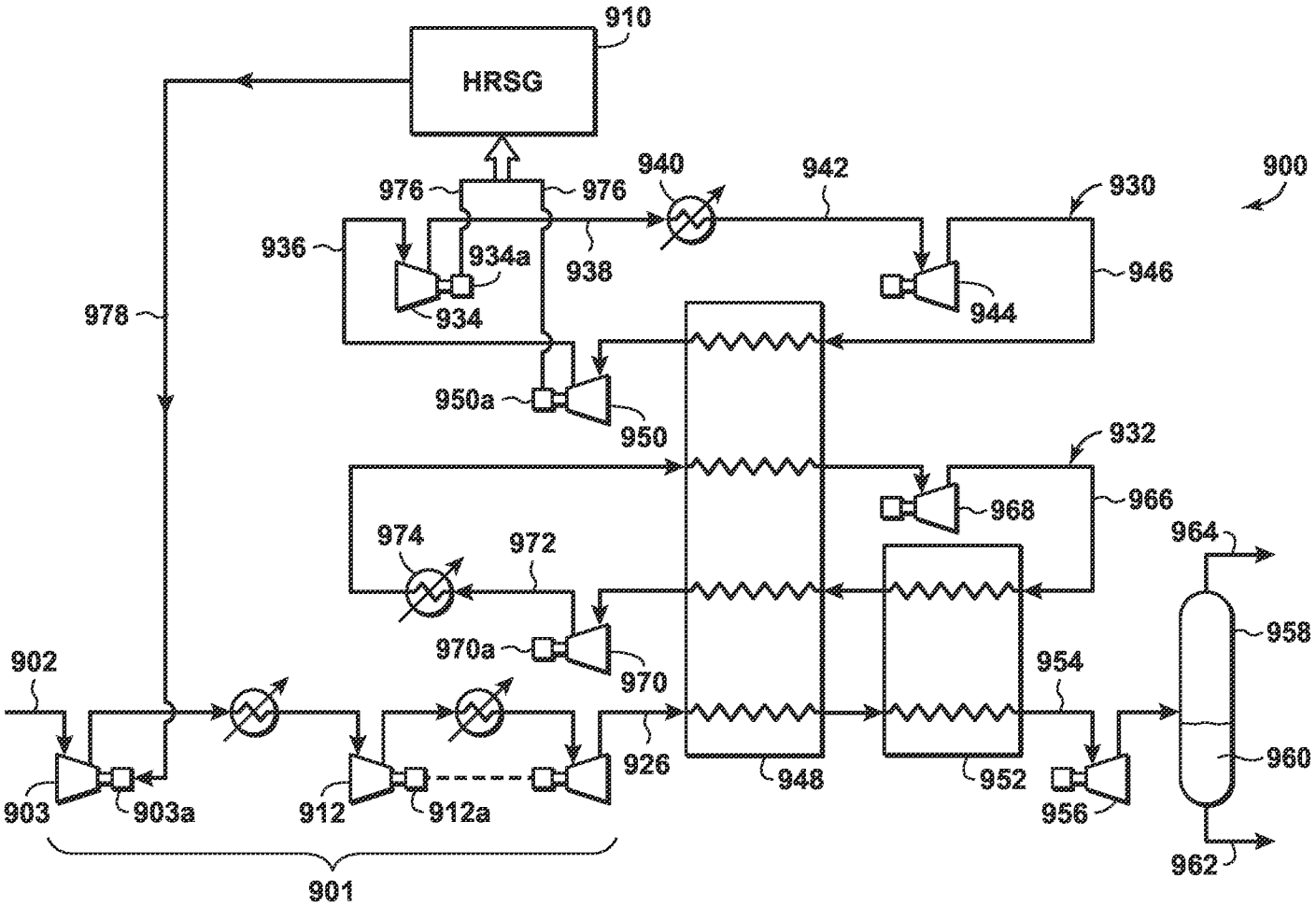
FIG. 9 is a schematic diagram of a system for producing LNG according aspects of the disclosure.

FIG. 9 is an illustration of an HPCE system 901 combined with a high-pressure expander process (HPXP process) 900 for liquefaction and a HRSG unit 910 according to aspects of the disclosure, which is more fully described in co-owned U.S. Patent Application Publication No. 2020/0064061, the disclosure of which is incorporated by reference herein in its entirety. HPXP process 900 uses high pressure within the primary cooling loop 930 to eliminate the need for external refrigerant and improve efficiency. HPXP process 900 employs high pressure expanders in a manner distinguishing from other expander cycles. A portion of the feed gas stream may be extracted and used as the refrigerant in either an open loop or closed loop refrigeration cycle (as shown) to cool the feed gas stream below its critical temperature. Alternatively, a portion of LNG boil-off gas may be extracted and used as the refrigerant in a closed loop refrigeration cycle to cool the feed gas stream below its critical temperature. This refrigeration cycle is referred to as the primary cooling loop 930. The primary cooling loop is followed by a sub-cooling loop 932 which acts to further cool the feed gas. Within the primary cooling loop, the refrigerant is compressed to a pressure greater than 10.3 MPa (1,500 psia), or more preferably, to a pressure of approximately 20.7 MPa (3,000 psia). The refrigerant is then cooled against an ambient cooling medium (air or water) prior to being near isentropically expanded to provide the cold refrigerant needed to liquefy the feed gas.

As with previous aspects, a natural gas stream may be treated to remove impurities, if present, such as water, heavy hydrocarbons, and sour gases, to produce a treated natural gas stream 902 that is suitable for liquefaction. The treated natural gas stream 902 may be directed to the HPCE process 901 as previously described herein. The HPCE process provides a chilled pretreated gas stream 926, which is directed to the HPXP process 900. In the expander loop 930, a compression unit 934 compresses a refrigerant stream 936 (which may be a treated gas stream) to a pressure greater than or equal to about 10.3 MPa (1,500 psia), thus providing a compressed refrigerant stream 938. Alternatively, the refrigerant stream 936 may be compressed to a pressure greater than or equal to about 11.0 MPa (1,600 psia), or greater than or equal to about 11.7 MPa (1,700 psia), or greater than or equal to about 12.4 MPa (1,800 psia), or greater than or equal to about 13.1 MPa (1,900 psia), or greater than or equal to about 13.8 MPa (2,000 psia), or greater than or equal to about 17.2 MPa (2,500 psia), or greater than or equal to about 20.7 MPa (3,000 psia), thus providing compressed refrigerant stream 938. Compression unit 934 may include a compressor powered by a gas turbine 934*a* (which may comprise a steam turbine in other aspects). After exiting compression unit 934, compressed refrigerant stream 938 is passed to a cooler 940 where it is cooled by indirect heat exchange with a suitable cooling fluid to provide a compressed, cooled refrigerant stream 942. Cooler 940 may be of the type that provides water or air as the cooling fluid, although any type of cooler can be used. The temperature of the compressed, cooled refrigerant stream 942 depends on the ambient conditions and the cooling medium used, and is typically from about 1.7° C. (35° F.) to about 40.6° C. (105° F.). Compressed, cooled refrigerant stream 942 is then passed to an expander 944 where it is expanded and consequently cooled to form an expanded refrigerant stream 946. Expander 944 is a work-expansion device, such as a gas expander, which produces work that may be extracted and used for compression. Expanded refrigerant stream 946 is passed to a first heat exchanger 948, and provides at least part of the refrigeration duty for first heat exchanger 948. Upon exiting first heat exchanger 948, expanded refrigerant stream 946 is fed to a compression unit 950 for pressurization to form refrigerant stream 936. Compression unit 950 may include a compressor powered by a steam turbine or a gas turbine 950*a*. Alternatively, the compressor in compression unit 950 may be powered by expander 944.

Chilled pretreated gas stream 926 flows through first heat exchanger 948 where it is cooled, at least in part, by indirect heat exchange with expanded refrigerant stream 946. After exiting first heat exchanger 948, the chilled pretreated gas stream 926 is passed to a second heat exchanger 952. The principal function of second heat exchanger 952 is to sub-cool the chilled pretreated gas stream. Thus, in second heat exchanger 952 the chilled pretreated gas stream 926 is sub-cooled by sub-cooling loop 932 (described below) to produce sub-cooled stream 954. Sub-cooled stream 954 is then expanded to a lower pressure in expander 956 to form a liquid fraction and a remaining vapor fraction. Expander 956 may be any pressure reducing device, including, but not limited to a valve, control valve, Joule Thompson valve, Venturi device, liquid expander, hydraulic turbine, and the like. The sub-cooled stream 954, which is now at a lower pressure and partially liquefied, is passed to a surge tank 958 where the liquefied fraction 960 thereof is withdrawn from the process as an LNG stream 962, which has a temperature corresponding to the bubble point pressure. The remaining vapor fraction (flash vapor) stream 964 may be used as fuel to power the compressor units.

In sub-cooling loop 932, an expanded sub-cooling refrigerant stream 966 (preferably comprising nitrogen) is discharged from an expander 968 and drawn through second and first heat exchangers 948, 952. Expanded sub-cooling refrigerant stream 966 is then sent to a compression unit 970 where it is re-compressed to a higher pressure and warmed. Compression unit 970 may include a compressor powered by a steam turbine or a gas turbine 970*a*. After exiting compression unit 970, the re-compressed sub-cooling refrigerant stream 972 is cooled in a cooler 974, which can be of the same type as cooler 940, although any type of cooler may be used. After cooling, the re-compressed sub-cooling refrigerant stream is passed to first heat exchanger 948 where it is further cooled by indirect heat exchange with expanded refrigerant stream 946 and expanded sub-cooling refrigerant stream 966. After exiting first heat exchanger 948, the re-compressed and cooled sub-cooling refrigerant stream is expanded through expander 968 to provide a cooled stream which is then passed through second heat exchanger 952 to sub-cool the portion of the feed gas stream to be finally expanded to produce LNG.

According to disclosed aspects, HRSG unit 910 may convert heat from any of the turbines 934*a*, 950*a*, 970*a* (that are gas turbines) into steam that may be used to power any of the turbines 934*a*, 950*a*, 970*a* that are steam-driven turbines (or turbines 903*a*, 912*a* that drive compressors 903, 912, respectively, in HPCE system 901, if they are steam-driven turbines). The arrangement depicted in FIG. 9, in which heat 976 from only turbines 934*a* and 950*a* is converted into steam 978 for use in turbine 903*a*, is merely an example of the source of heat and the destination of the steam. Other combinations of heat sources and steam destinations in the system of FIG. 9 are possible and are within the scope of the disclosure.

FIG. 9 depicts aspects of the disclosure used with an HPXP process. The disclosure may also be used with liquefaction processes employing other refrigeration sub-processes, such as the feed gas expander-based LNG liquefaction disclosed in co-owned U.S. Patent Application Publication No. 2017/0167786, the disclosure of which is incorporated by reference herein in its entirety.

Figure 10:
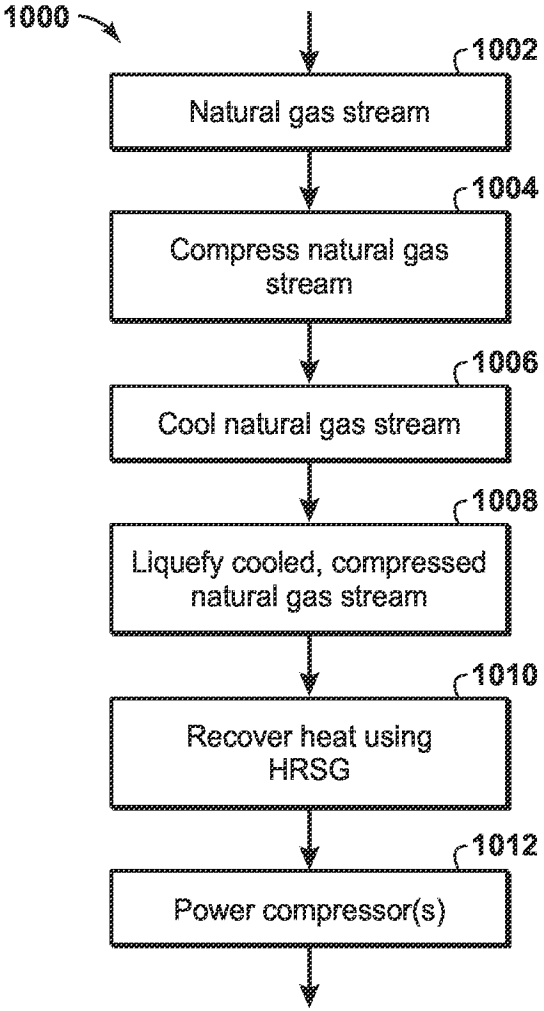
FIG. 10 is a flowchart of a method according to aspects of the disclosure.

FIG. 10 is a flowchart showing a method 1000 of producing liquefied natural gas (LNG) from a natural gas stream according to disclosed aspects. At block 1002 a natural gas stream is provided at a pressure of less than 8.27 MPa (1,200 psia) from a supply of natural gas. At block 1004 the natural gas stream is compressed, using a first compressor and a second compressor, to a pressure of at least 10.34 MPa (1,500 psia). At block 1006 the natural gas stream is cooled between the first compressor and the second compressor so that the second compressor produces a cooled, compressed natural gas stream. At block 1008 the cooled, compressed natural gas stream is liquefied in a liquefaction process that uses a refrigerant compressor configured to compress a stream of refrigerant used to chill, condense, or liquefy the cooled, compressed natural gas stream. At block 1010 a heat recovery steam generation (HRSG) system is used to recover heat from a power source of the refrigerant compressor and generate a stream of pressurized steam from the recovered heat. At block 1012 at least one of the first and second compressors is powered using at least part of the stream of pressurized steam.

Figure 11:
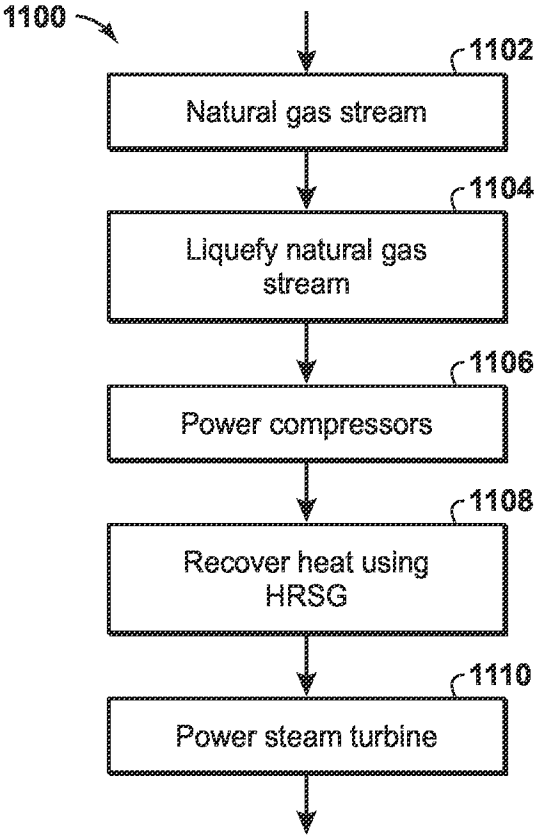
FIG. 11 is a flowchart of a method according to aspects of the disclosure.

FIG. 11 is a flowchart showing a method 1100 of producing liquefied natural gas (LNG) according to disclosed aspects. At block 1102 a natural gas stream is provided. At block 1104 the natural gas stream is liquefied in a liquefaction process. The liquefaction process uses a first compressor and a second compressor to compress one or more refrigerants used to chill, condense, or liquefy the chilled natural gas stream. At block 1106 the first compressor is powered with a gas turbine and the second compressor is powered with a steam turbine. At block 1108 a heat recovery steam generation (HRSG) system is used to recover heat from the gas turbine and to generate a stream of pressurized steam from the recovered heat. At block 1110 the steam turbine is powered using at least part of the stream of pressurized steam.

Further illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

1. A method of producing liquefied natural gas (LNG), the method comprising:
   providing a natural gas stream at a pressure of less than 8.27 MPa (1,200 psia) from a supply of natural gas;
   compressing the natural gas stream to a pressure of at least 10.34 MPa (1,500 psia), wherein the compressing is performed using a first compressor and a second compressor;
   between the first compressor and the second compressor, cooling the natural gas stream so that the second compressor produces a cooled, compressed natural gas stream;
   liquefying the cooled, compressed natural gas stream in a liquefaction process, the liquefaction process using a refrigerant compressor configured to compress a stream of refrigerant used to chill, condense, or liquefy the cooled, compressed natural gas stream;
   using a heat recovery steam generation (HRSG) system, recovering heat from a power source of the refrigerant compressor and generating a stream of pressurized steam from the recovered heat; and
   powering at least one of the first and second compressors using at least part of the stream of pressurized steam.
2. The method of paragraph 1, wherein cooling the compressed natural gas stream comprises cooling the compressed natural gas stream in at least one heat exchanger that exchanges heat with the environment.
3. The method of paragraph 2, wherein the liquefaction process comprises a dual mixed refrigerant process using a combination of first and second refrigeration sub-processes to liquefy the natural gas stream, and wherein the refrigerant compressor is a compressor for one of the refrigeration sub-processes.
4. The method of paragraph 3, further comprising a fourth compressor that provides compression for the second refrigeration sub-process, wherein the HRSG system recovers heat generated by a power source of the fourth compressor to further generate the stream of pressurized steam.
5. The method of paragraph 1, wherein the liquefaction process comprises a single mixed refrigerant process using a refrigeration sub-process cycle to liquefy the natural gas stream, and wherein the refrigerant compressor is a compressor for the refrigeration sub-process.
6. The method of paragraph 1, wherein the liquefaction process comprises a high pressure expansion process with a cooling cycle and a sub-cooling cycle, and wherein the refrigerant compressor is a compressor for the cooling cycle or the sub-cooling cycle.

7. The method of any one of paragraphs 1-6, wherein the first and second compressors compress the natural gas stream to a pressure greater than 20.68 MPa (3,000 psia).
8. The method of any one of paragraphs 1-7, wherein the natural gas expander is a work producing expander that expands the cooled compressed natural gas stream to a pressure less than 13.79 MPa (2,000 psia).
9. The method of any one of paragraphs 1-8, further comprising:

prior to the liquefying step, expanding, in at least one work producing natural gas expander, the cooled compressed natural gas stream to a pressure that is less than 13.79 MPa (2,000 psia) and no greater than the pressure to which the natural gas stream was compressed.

10. The method of paragraph 9, wherein the natural gas expander is mechanically coupled to the first compressor or to the second compressor.
11. The method of any one of paragraphs 1-10, wherein the stream of pressurized steam is directed to a steam turbine that powers the first compressor or the second compressor.
12. The method of paragraph 11, wherein the steam turbine is one of a condensing-type steam turbine with or without side extraction, and a back pressure type steam turbine.

13. The method of any one of paragraphs 1-12, wherein the liquefaction process comprises two or more liquefaction modules, wherein each of the two or more liquefaction modules has a HRSG system associated therewith, and wherein the first compressor is powered using at least part of streams of pressurized steam generated by the HRSG systems associated with the two or more liquefaction modules.
14. A system for producing liquefied natural gas (LNG) from a natural gas stream, comprising:

a first compressor and a second compressor configured to compress a natural gas stream from a pressure of less than 8.27 MPa (1,200 psia) to a pressure of at least 10.34 MPa (1,500 psia);

a heat exchanger disposed between the first compressor and the second compressor, the heat exchanger configured to cool the natural gas stream so that the second compressor produces a cooled, compressed natural gas stream;

a liquefaction process configured to liquefy the cooled, compressed natural gas stream, wherein the liquefaction process includes a refrigerant compressor configured to compress a stream of refrigerant used to chill, condense, or liquefy the cooled, compressed natural gas stream, and wherein the refrigerant compressor is powered by a power source; and a heat recovery steam generation (HRSG) system configured to recover heat from the power source of the refrigerant compressor to thereby generate a stream of pressurized steam from the recovered heat;

wherein at least one of the first and second compressors are powered using at least part of the stream of pressurized steam.

15. The system of paragraph 14, wherein the heat exchanger is configured to cool the compressed natural gas stream by exchanging heat with the environment.
16. The system of paragraph 15, wherein the liquefaction process comprises a dual mixed refrigerant process using a combination of first and second refrigeration sub-processes to liquefy the natural gas stream, and wherein the refrigerant compressor is a compressor for one of the refrigeration sub-processes.
17. The system of paragraph 16, further comprising a fourth compressor that provides compression for the second refrigeration cycle, wherein the HRSG system is configured to recover heat generated by a power source of the fourth compressor to further generate the stream of pressurized steam.
18. The system of paragraph 14, wherein the liquefaction process comprises a single mixed refrigerant process using a refrigeration sub-process cycle to liquefy the natural gas stream, and wherein the refrigerant compressor is a compressor for the refrigeration sub-process.
19. The system of paragraph 14, wherein the liquefaction process comprises a high pressure expansion process with a cooling cycle and a sub-cooling cycle, and wherein the refrigerant compressor is a compressor for the cooling cycle or the sub-cooling cycle.
20. The system of any one of paragraphs 14-19, wherein the first and second compressors are configured to compress the natural gas stream to a pressure greater than 20.68 MPa (3,000 psia).
21. The system of any one of paragraphs 14-20, wherein the natural gas expander is a work producing expander configured to expand the cooled compressed natural gas stream to a pressure less than 13.79 MPa (2,000 psia).
22. The system of any one of paragraphs 14-21, further comprising:

at least one work producing natural gas expander arranged between the second compressor and the liquefaction process, the at least one work producing natural gas expander configured to expand the cooled compressed natural gas stream to a pressure that is less than 13.79 MPa (2,000 psia) and no greater than the pressure to which the natural gas stream was compressed.

23. The system of paragraph 22, wherein the natural gas expander is mechanically coupled to the first compressor or to the second compressor.
24. The system of any one of paragraphs 14-23, further comprising:

a steam turbine operationally connected to the first compressor or the second compressor, wherein the stream of pressurized steam is directed to the steam turbine.

25. The system of paragraph 24, wherein the steam turbine is one of a condensing-type steam turbine with or without side extraction, and a back pressure type steam turbine.

26. The system of any one of paragraphs 14-25, wherein the liquefaction process comprises two or more liquefaction modules, wherein each of the two or more liquefaction modules has a HRSG system associated therewith, and wherein the first compressor is powered using at least part of streams of pressurized steam generated by the HRSG systems associated with the two or more liquefaction modules.
27. A method of producing liquefied natural gas (LNG), the method comprising:

providing a natural gas stream;

liquefying the natural gas stream in a liquefaction process, the liquefaction process using a first compressor and a second compressor to compress one or more refrigerants used to chill, condense, or liquefy the chilled natural gas stream;

powering the first compressor with a gas turbine;

powering the second compressor with a steam turbine;

using a heat recovery steam generation (HRSG) system, recovering heat from the gas turbine and generating a stream of pressurized steam from the recovered heat; and powering the steam turbine using at least part of the stream of pressurized steam.

28. The method of paragraph 27, further comprising:

additionally powering the steam turbine using steam from a source other than the stream of pressurized steam generated from the heat from the gas turbine.

29. The method of paragraph 27, wherein the liquefaction process comprises a dual mixed refrigerant process using a combination of a first refrigerant cycle and a second refrigerant cycle to liquefy the natural gas stream, and wherein the first compressor is a compressor for the first refrigerant cycle.

30. The method of paragraph 27, wherein the steam turbine is one of a condensing-type steam turbine with or without side extraction, and a back pressure type steam turbine.

31. The method of paragraph 27, further comprising:

shifting a compression load between the first compressor and the second compressor according to power available from the HRSG system.

32. A system for producing liquefied natural gas (LNG) from a natural gas stream, comprising:

a liquefaction process in which the natural gas stream is liquefied, the liquefaction process including a first compressor and a second compressor configured to compress one or more refrigerants used to chill, condense, or liquefy the chilled natural gas stream;

a gas turbine configured to power the first compressor;

a steam turbine configured to power the second compressor; and a heat recovery steam generation (HRSG) system configured to recover heat from the gas turbine and generate a stream of pressurized steam from the recovered heat;

wherein the steam turbine is powered using at least part of the stream of pressurized steam.

33. The system of paragraph 32, wherein the steam turbine is additionally powered using steam from a source other than the stream of pressurized steam generated from the heat from the gas turbine.

34. The system of paragraph 32, wherein the liquefaction process comprises a dual mixed refrigerant process using a combination of a first refrigerant cycle and a second refrigerant cycle to liquefy the natural gas stream, and wherein the first compressor is a compressor for the first refrigerant cycle.

35. The system of paragraph 32, wherein the steam turbine is one of a condensing-type steam turbine with or without side extraction, and a back pressure type steam turbine.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What we claim:

1. A method of producing liquefied natural gas (LNG), the method comprising:

providing a natural gas stream at a pressure of less than 8.27 MPa (1,200 psia) from a supply of natural gas;

compressing the natural gas stream to a pressure of at least 10.34 MPa (1,500 psia), wherein the compressing is performed using a first compressor and a second compressor;

between the first compressor and the second compressor, cooling the natural gas stream so that the second compressor produces a cooled, compressed natural gas stream;

liquefying the cooled, compressed natural gas stream in a liquefaction process, the liquefaction process using a refrigerant compressor configured to compress a stream of refrigerant used to chill, condense, or liquefy the cooled, compressed natural gas stream;

using a heat recovery steam generation (HRSG) system, recovering heat from a power source of the refrigerant compressor and generating a stream of pressurized steam from the recovered heat; and powering at least one of the first and second compressors using at least part of the stream of pressurized steam.

2. The method of claim 1, wherein cooling the compressed natural gas stream comprises cooling the compressed natural gas stream in at least one heat exchanger that exchanges heat with an environment.

3. The method of claim 2, wherein the liquefaction process comprises a dual mixed refrigerant process using a combination of first and second refrigeration sub-processes to liquefy the natural gas stream, and wherein the refrigerant compressor is a compressor for one of the refrigeration sub-processes.

4. The method of claim 3, further comprising a fourth compressor that provides compression for the second refrigeration cycle, wherein the HRSG system recovers heat generated by a power source of the fourth compressor to further generate the stream of pressurized steam.

5. The method of claim 1, wherein the liquefaction process comprises a single mixed refrigerant process using a refrigeration sub-process cycle to liquefy the natural gas stream, and wherein the refrigerant compressor is a compressor for the refrigeration sub-process.

6. The method of claim 1, wherein the liquefaction process comprises a high pressure expansion process with a cooling cycle and a sub-cooling cycle, and wherein the refrigerant compressor is a compressor for the cooling cycle or the sub-cooling cycle.

7. The method of claim 1, wherein the first and second compressors compress the natural gas stream to a pressure greater than 20.68 MPa (3,000 psia).

8. The method of claim 1, wherein the natural gas expander is a work producing expander that expands the cooled compressed natural gas stream to a pressure less than 13.79 MPa (2,000 psia).

9. The method of claim 1, further comprising:

prior to the liquefying step, expanding, in at least one work producing natural gas expander, the cooled compressed natural gas stream to a pressure that is less than 13.79 MPa (2,000 psia) and no greater than the pressure to which the natural gas stream was compressed.

10. The method of claim 9, wherein the natural gas expander is mechanically coupled to the first compressor or to the second compressor.

11. The method of claim 1, wherein the liquefaction process comprises two or more liquefaction modules, wherein each of the two or more liquefaction modules have a HRSG system associated therewith, and wherein the first compressor is powered using at least part of streams of pressurized steam generated by the HRSG systems associated with the two or more liquefaction modules.

* * * * *